US008544901B2

(12) United States Patent
Krishnan et al.

(10) Patent No.: US 8,544,901 B2
(45) **Date of Patent: *Oct. 1, 2013**

(54) UNIVERSAL GLOBAL LATCH SYSTEM

(75) Inventors: Venky Krishnan, Wayne, MI (US); Kosta Papanikolaou, Huntington Woods, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 710 days.

This patent is subject to a terminal disclaimer.

(21) Appl. No.: 12/402,792

(22) Filed: Mar. 12, 2009

(65) Prior Publication Data

US 2010/0235059 A1 Sep. 16, 2010

(51) Int. Cl.
*E05C 3/06* (2006.01)

(52) U.S. Cl.
USPC ..... 292/216; 292/201; 292/DIG. 23

(58) Field of Classification Search
CPC ..... E05B 17/0025; E05B 47/0012; E05B 63/0013; E05B 81/14; E05B 85/26; E05B 1/06
USPC ..... 292/194, 195, 196, 201, 216, DIG. 23, 292/112, 179, 280, 336.3, DIG. 12, DIG. 15, 292/1; 49/280
See application file for complete search history.

(56) References Cited

U.S. PATENT DOCUMENTS 4,702,117 A 10/1987 Tsutsumi et al.
4,848,031 A 7/1989 Yamagishi et al.
4,929,007 A 5/1990 Bartczak et al.
5,618,068 A 4/1997 Mitsui et al.
5,632,515 A 5/1997 Dowling
5,653,484 A * 8/1997 Brackmann et al. ..... 292/216
5,802,894 A 9/1998 Jahrsetz et al.
5,896,768 A 4/1999 Cranick et al.
5,921,612 A 7/1999 Mizuki et al.
6,000,257 A * 12/1999 Thomas ..... 70/279.1
6,099,048 A * 8/2000 Salmon et al. ..... 292/216
6,125,583 A 10/2000 Murray et al.
6,256,932 B1 7/2001 Jyawook et al.
6,361,091 B1 3/2002 Weschler
6,441,512 B1 * 8/2002 Jakel et al. ..... 307/10.2
6,470,719 B1 10/2002 Franz et al.
6,523,376 B2 2/2003 Baukholt et al.
6,554,328 B2 4/2003 Cetnar et al.

(Continued)

OTHER PUBLICATIONS

U.S. Appl. No. 11/164,369, Office Action mailed Mar. 20, 2007.

(Continued)

*Primary Examiner* — Kristina R Fulton
*Assistant Examiner* — Nathan Cumar
(74) *Attorney, Agent, or Firm* — Raymond Coppiellie; Price Heneveld LLP

(57) ABSTRACT

A latch system for a door of a vehicle including a latch assembly having a catch and a pawl, an actuatable inside handle, and an actuator engaged with the pawl and being configured to be activated by actuation of the inside handle. The catch is configured to be moved to an open position by activating the actuator to thereby move the pawl to stop the pawl from maintaining the catch in the closed position. The catch is also configured to be moved to the open position after actuation of the inside handle by having the inside handle mechanically move the toggle lever to stop the pawl from maintaining the catch in the closed position to when the vehicle does not have power.

20 Claims, 8 Drawing Sheets

(56) References Cited

U.S. PATENT DOCUMENTS

| | | | | |
|---|---|---|---|---|
| 6,629,711 | B1 | 10/2003 | Gleason et al. | |
| 7,097,226 | B2 * | 8/2006 | Bingle et al. | 296/76 |
| 7,221,255 | B2 * | 5/2007 | Johnson et al. | 340/5.61 |
| 7,399,010 | B2 | 7/2008 | Hunt et al. | |
| 2004/0195845 | A1 | 10/2004 | Chevalier | |
| 2007/0170727 | A1 * | 7/2007 | Kohlstrand et al. | 292/216 |
| 2008/0203737 | A1 * | 8/2008 | Tomaszewski et al. | 292/216 |
| 2008/0217956 | A1 * | 9/2008 | Gschweng et al. | 296/146.1 |
| 2009/0033104 | A1 * | 2/2009 | Konchan et al. | 292/216 |
| 2010/0052337 | A1 | 3/2010 | Arabia, Jr. et al. | |

OTHER PUBLICATIONS

U.S. Appl. No. 11/164,369, Response filed May 29, 2007.
U.S. Appl. No. 11/164,369, Office Action mailed Aug. 7, 2007.
U.S. Appl. No. 11/164,369, Response filed Dec. 3, 2007.
U.S. Appl. No. 11/164,369, Office Action mailed Feb. 11, 2008.
U.S. Appl. No. 11/164,369, Response filed May 7, 2008.
U.S. Appl. No. 11/164,369, Office Action mailed Aug. 25, 2008.
U.S. Appl. No. 11/164,369, Request for Continued Examination/Amendment filed Nov. 11, 2008.
U.S. Appl. No. 11/164,369, Office Action mailed Jan. 21, 2009.
U.S. Appl. No. 11/164,369, Response filed Apr. 14, 2009.
U.S. Appl. No. 11/164,369, Office Action mailed Jul. 22, 2009.
U.S. Appl. No. 11/164,369, Response filed Sep. 22, 2009.
U.S. Appl. No. 11/164,369, Office Action mailed Oct. 7, 2009.
U.S. Appl. No. 11/164,369, Request for Continued Examination/Amendment filed Nov. 23, 2009.
U.S. Appl. No. 11/164,369, Office Action mailed Dec. 23, 2009.
U.S. Appl. No. 11/164,369, Response filed Mar. 22, 2010.

* cited by examiner

UNIVERSAL GLOBAL LATCH SYSTEM

FIELD OF THE INVENTION

The present invention concerns vehicles, and more particularly relates to a latch system for a door of a vehicle.

BACKGROUND OF THE INVENTION

Heretofore, as is known in the art, vehicle door latch assemblies generally include a latch mechanism operable by means of inner and outer door handles. Such latch assemblies can vary in design based on a variety of factors such as the type of vehicle (e.g., car, minivan, truck, etc.), as well as the location of the latch assembly on the specific vehicle. For example, a latch assembly located on a front door of a vehicle may be operable in a single or double pull mode of an inside handle, whereas a latch assembly located on a rear door may require additional child-lock related operability (e.g., no latch over-ride). In Europe, however, the same vehicle may include a rear door latch over-ride. Thus, for a single car, four unique latch assemblies (front/rear, left/right) may be required, with each latch assembly including uniquely designed mechanical features. Moreover, the same vehicle may include yet further latch operation variations when sold in different countries.

For automobiles produced by the millions, reduction of any such variations can result in significant cost savings from design, manufacturing and servicing perspectives. Yet further, streamlining of such functions in one or more latch assemblies can further provide greater flexibility in the ability to customize such functions, and thus greater customer satisfaction.

SUMMARY OF THE PRESENT INVENTION

An aspect of the present invention is to provide a latch system for a door of a vehicle comprising a latch assembly, an actuatable inside handle, an actuator and an emergency release lever. The latch assembly is for maintaining the door in a closed location. The latch assembly includes a catch and a pawl. The catch has a closed position wherein the catch is configured to grasp a portion of the vehicle to maintain the door in the closed location and an open position wherein the catch is configured to release the portion of the vehicle to allow the door to move to an open location. The pawl is configured to maintain the catch in the closed position. The actuator is engaged with the latch assembly, with the actuator being configured to be activated by actuation of the inside handle. The emergency release lever is movable between an on position and an off position, with the emergency release lever being engaged with the actuatable inside handle. The catch is configured to be moved to the open position after actuation of the inside handle by activating the actuator to thereby move the pawl to stop the pawl from maintaining the catch in the closed position when the vehicle has power. The catch is configured to be moved to the open position after actuation of the inside handle by moving the emergency release lever to the on position to mechanically interconnect the inside handle with the pawl to stop the pawl from maintaining the catch in the closed position. The inside handle is not mechanically interconnected to the pawl when the emergency release lever is in the off position such that actuation of the inside handle will not mechanically move the pawl when the emergency release lever is in the off position.

Another aspect of the present invention is to provide a method of controlling a location of a door of a vehicle comprising providing a latch assembly for maintaining the door in a closed location, with the latch assembly including a catch and a pawl. The catch has a closed position wherein the catch is configured to grasp a portion of the vehicle to maintain the door in the closed location and an open position wherein the catch is configured to release the portion of the vehicle to allow the door to move to an open location. The pawl is configured to maintain the catch in the closed position. The method also includes providing an actuatable inside handle, engaging an actuator with the latch assembly, and providing an emergency release lever being movable between an on position and an off position, with the emergency release lever being engaged with the actuatable inside handle. The method further includes opening the door when the vehicle has power by moving the catch to the open position by actuating the inside handle to activate the actuator to thereby move the pawl to stop the pawl from maintaining the catch in the closed position. The method also includes opening the door by moving the catch to the open position after actuation of the inside handle by moving the emergency release lever to the on position and mechanically interconnecting the inside handle with the pawl to stop the pawl from maintaining the catch in the closed position. The inside handle is not mechanically interconnected to the pawl when the emergency release lever is in the off position such that actuation of the inside handle will not mechanically move the pawl when the emergency release lever is in the off position.

Yet another aspect of the present invention is to provide a latch system for a door of a vehicle comprising a latch assembly, an actuatable inside handle, an actuatable outside handle, an actuator engaged with the latch assembly, and an emergency release lever. The latch assembly is for maintaining the door in a closed location, with the latch assembly including a catch and a pawl. The catch has a closed position wherein the catch is configured to grasp a portion of the vehicle to maintain the door in the closed location and an open position wherein the catch is configured to release the portion of the vehicle to allow the door to move to an open location. The pawl is configured to maintain the catch in the closed position. The latch assembly has a locked condition wherein the pawl is prevented from releasing the catch. The actuator is configured to be activated by actuation of the inside handle and actuation of the outside handle. The emergency release lever is movable between an on position and an off position, the emergency release lever being engaged with the actuatable inside handle. The catch is configured to be moved to the open position after actuation of the inside handle by activating the actuator to thereby move the pawl to stop the pawl from maintaining the catch in the closed position when the vehicle has power. The catch is configured to be moved to the open position after actuation of the inside handle by moving the emergency release lever to the on position to mechanically interconnect the inside handle with the pawl to stop the pawl from maintaining the catch in the closed position. The inside handle is not mechanically interconnected to the pawl when the emergency release lever is in the off position such that actuation of the inside handle will not mechanically move the pawl when the emergency release lever is in the off position. If the latch assembly is in the locked condition, the actuator prevents actuation of the inside handle from actuating the pawl to stop the pawl from maintaining the catch in the closed position. The catch is configured to be moved to the open position after actuation of the outside handle by activating the actuator to thereby move the pawl to stop the pawl from maintaining the catch in the closed position when the vehicle has power and when the latch assembly is in the locked condition. These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
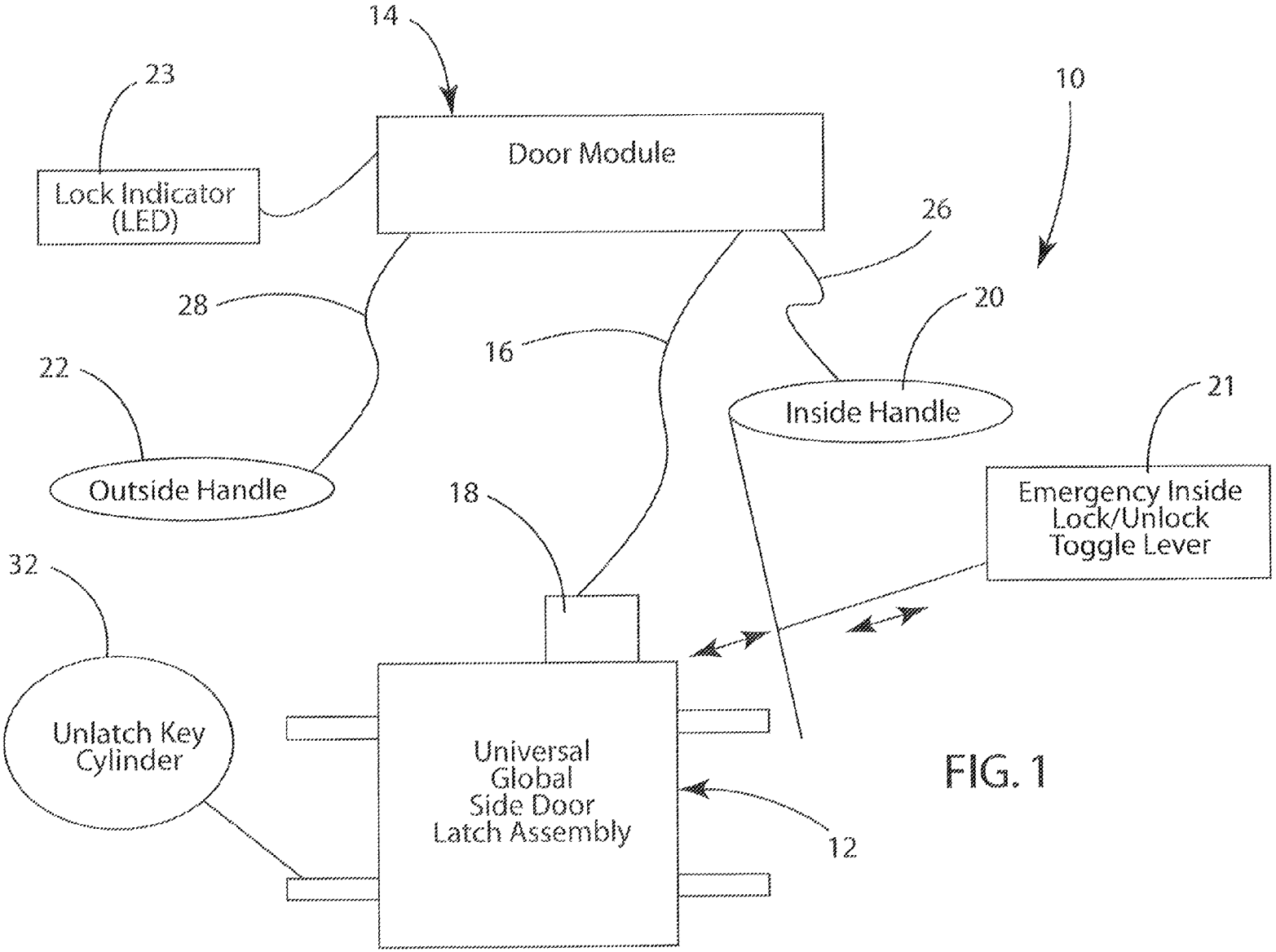
FIG. 1 is a schematic view of a latch system of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a latch system of the present invention. The latch system 10 can be used in any vehicle having doors and includes a latch assembly 12 for each door, with each latch assembly 12 being configured to keep their associated door closed or to allow their associated door to open. In a preferred embodiment, all of the latch assemblies 12 in the vehicle are substantially identical. However, it is contemplated that not all of the latch assemblies 12 need to be substantially identical (e.g., the front doors can have different latch assemblies 12 than the rear doors or all doors can have different latch assemblies 12).

In the illustrated example, the latch system 10 can be used in a vehicle having a centralized control system for controlling the latch assemblies 12 for all doors of the vehicle or a control system for controlling the latch assembly 12 for a single door. The centralized control system can be used to open a door, to keep the door closed or to provide certain functionality to the latch assembly (for example, locking, unlocking, child-locking, double locking, etc.) for a particular door or for each latch assembly 12. Accordingly, the structure of the latch assemblies 12 for each of the doors can be structurally identical, with the centralized control system individually and selectively altering the functionality for each door. As illustrated in FIG. 1, a door module 14 represents the control system for the latch assembly 12. The door module 14 can be connected to one latch assembly 12 for one door (as shown) or can be connected to multiple latch assemblies 12 for multiple doors. The door module 14 can include a microprocessor and a memory unit and communicates with the latch assembly 12 via an electrical control line 16 (either wired or wireless). For example, the electrical control line 16 can include a single-control bus with a return through a common chassis ground.

In the illustrated embodiment, each of the latch assemblies 12 can be associated with a respective control and driver circuit including a microprocessor which is, in turn, associated with an actuator 18 as discussed in more detail below. The actuator 18 may be connected to the driver circuit through a bistable relay. The circuits can include or can be programmed to be demultiplexers for receiving serial control signals transmitted over the electrical control line 16 and for converting them to control signals for the actuator 18. Correspondingly, the door module 14 can have its microprocessor programmed to constitute a multiplexer or can include a separate multiplexer. While the system as thus far described uses unidirectional information or control signal flow, a bidirectional signal transmission is also possible. For example, the processors of the circuits can dialogue with the door module 14 and can transmit signals indicating the state of the respective latch assembly 12 to the door module 14. Each of the processors of the control and driver circuits can be provided with a lock identity code word storage or memory. Correspondingly, the door module 14 can have a memory for storage connected to its central processor and serving as control system identity code word storage. Each of the identity code word memories or storage has a respective identity code word stored therein and can output this code word upon interrogation so that the code words can be compared with one another. Upon a failure of agreement between interrogated identity code words, the latch assemblies 12 are automatically brought into the "antitheft securing mode on" and "child-safety mode on" positions and deactivated to prevent opening of the door. Alternatively or simultaneously, the door module 14 can be deactivated.

The illustrated latch system 10 as illustrated in FIG. 1 includes the latch assembly 12 connected to the door module 14 via the electrical control line 16 as discussed above. The latch assembly 12 also includes an inside handle 20 located within an interior of the vehicle and an outside handle 22 located at an exterior of the vehicle. The inside handle 20 electrically communicates with the door module 14 via an inside handle electrical control line 26 (either wired or wireless). In the illustrated embodiment, the outside handle 22 also electrically communicates with the door module 14 via an outside handle electrical control line 28 (either wired or wireless). The door module 14 receives signals from the inside handle 20 or the outside handle 22 and can send a signal to the actuator 18 instructing the actuator 18 to actuate the latch assembly 12 to allow the door of the vehicle to open. Accordingly, all features of the latch assembly 12 can be maintained in the programming of the door module 14. For example, the door module 14 can determine that the latch assembly 12 is locked such that the latch assembly 12 will not open on only actuation of the inside handle 20 or the outside handle 22. Therefore, the latch assembly 12 will not need structure for keeping the latch assembly 12 in a locked condition—the door module 14 keeps the latch assembly 12 in the locked condition. Other features of the latch assembly 12 (e.g., child locks) can also be controlled by the door module 14 such that the structure of every latch assembly 12 in a vehicle can be identical. The inside handle 20 can be mechanically connected to the latch assembly 12 via an emergency inside lock/unlock toggle lever 21 as discussed in more detail below. Moreover, the latch system 10 can also include an unlatch key cylinder 32 mechanically connected to the latch assembly 12 for allowing the latch assembly 12 to allow its associated door to open from an exterior of the vehicle. It is contemplated that only the driver side door, the front doors or all the doors could include the unlatch key cylinder 32.

Figure 3:
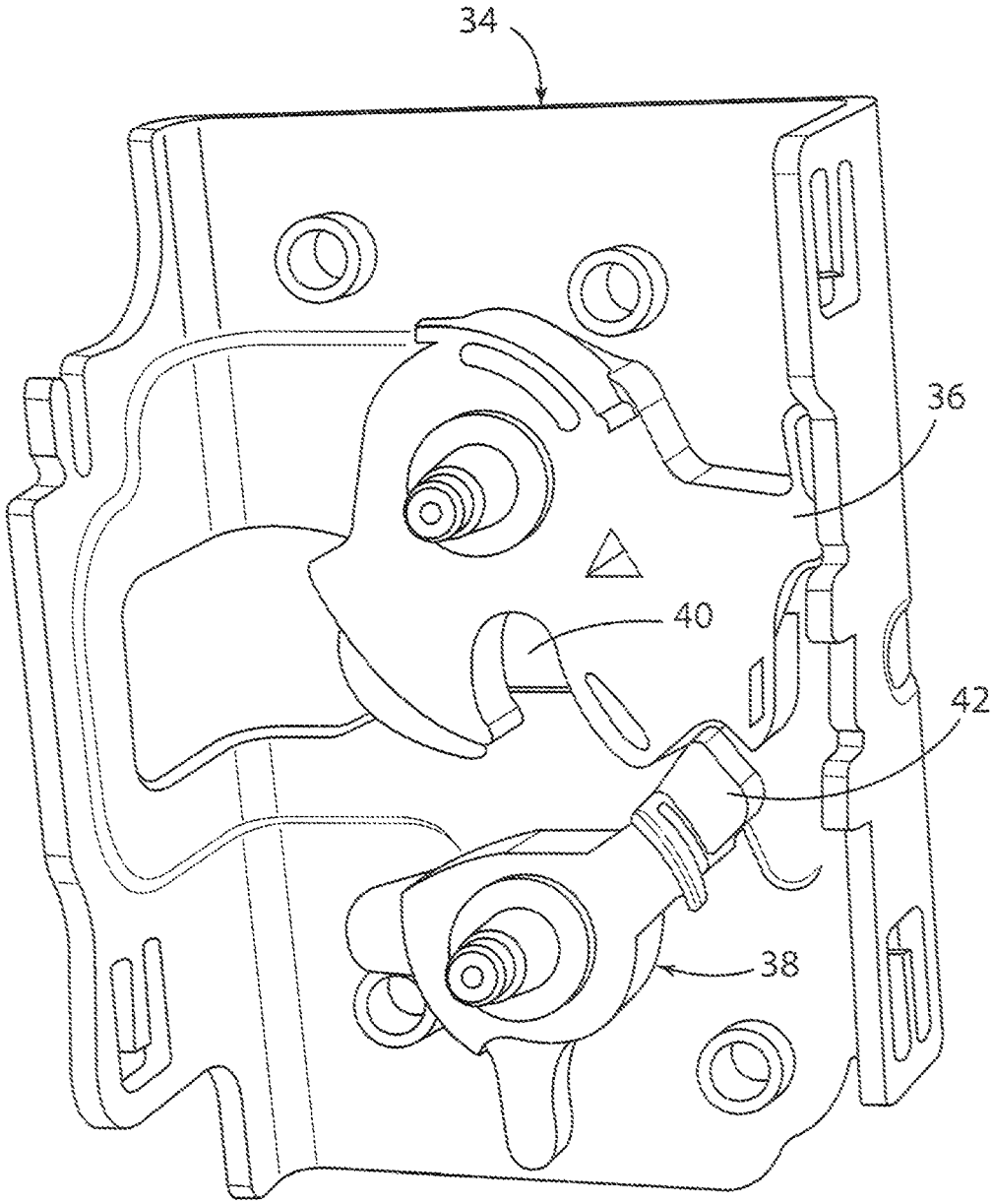
FIG. 3 is a partial perspective view of a typical latch for a door.

In the illustrated example, the latch assembly 12 (FIG. 3) is configured to maintain the door in a closed location and to allow the door to move to an open location. The latch assembly 12 includes a latch housing 34 having a catch 36 and a pawl 38. As is well known to those skilled in the art, the catch 36 includes a slot 40 configured to selectively accept a post (not shown) of a vehicle frame to maintain the door in the closed location. FIG. 3 illustrates the catch 36 in a closed position wherein the post of the vehicle would be trapped within the slot 40 such that the door is maintained in the closed location. The pawl 38 is configured to maintain the catch 36 in the closed position by having an extension 42 of the pawl 38 abut against the catch 36 to prevent rotation of the catch 36. The pawl 38 is configured to rotate clockwise as shown in FIG. 3 to allow the catch 36 to rotate. Once the pawl 38 moves out of engagement with the catch 36, the catch 36 is configured to rotate clockwise as shown in FIG. 3 to an open position to release the post of the vehicle frame, thereby allowing the door to move to an open location. The structure and function of the catch 36 and the pawl 38 as discussed directly above are well known to those skilled in the art. An aspect of the present invention is to include the emergency inside lock/unlock toggle lever 21 for allowing the inside handle 20 to selectively and mechanically interact with the latch assembly 12.

Figure 2:
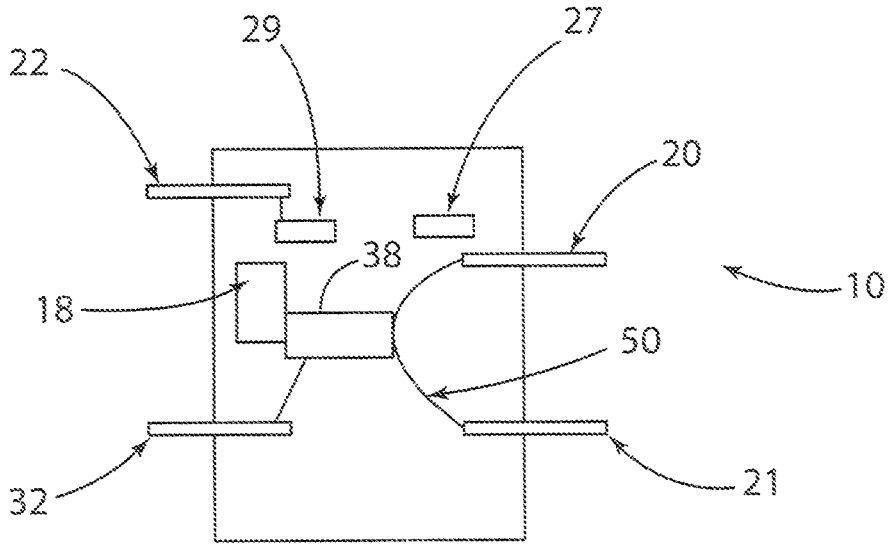
FIG. 2 is another schematic view of the latch system of the present invention.

FIG. 2 illustrates a schematic drawing of the latch system 10 of the present invention. As illustrated in FIG. 2, the inside handle 20 is configured to actuate an inside switch 27 that sends a signal to the door module 14 (via the inside handle electrical control line 26) telling the door module 14 that someone inside the vehicle desires the door to move to the open location. Under the correct conditions as discussed below, the door would then move to the open location. Likewise, the outside handle 22 is configured to actuate an outside switch 29 that sends a signal to the door module 14 (via the outside handle electrical control line 28) telling the door module 14 that someone outside the vehicle desires the door to move to the open location. Under the correct conditions as discussed below, the door would then move to the open location. After actuation of the inside handle 20 or the outside handle 22, the door module 14 will send a signal to the actuator 18 via the electrical control line 16 telling the actuator 18 to activate to thereby move the pawl 38 to stop the pawl 38 from maintaining the catch 36 in the closed position, thereby allowing the door to move to the open location. Moreover, the pawl 38 can be moved mechanically to thereby stop maintaining the catch 36 in the closed position by the inside handle 20 after actuation of the emergency inside lock/unlock toggle lever 21 or by actuation of the unlatch key cylinder 32.

Figure 4:
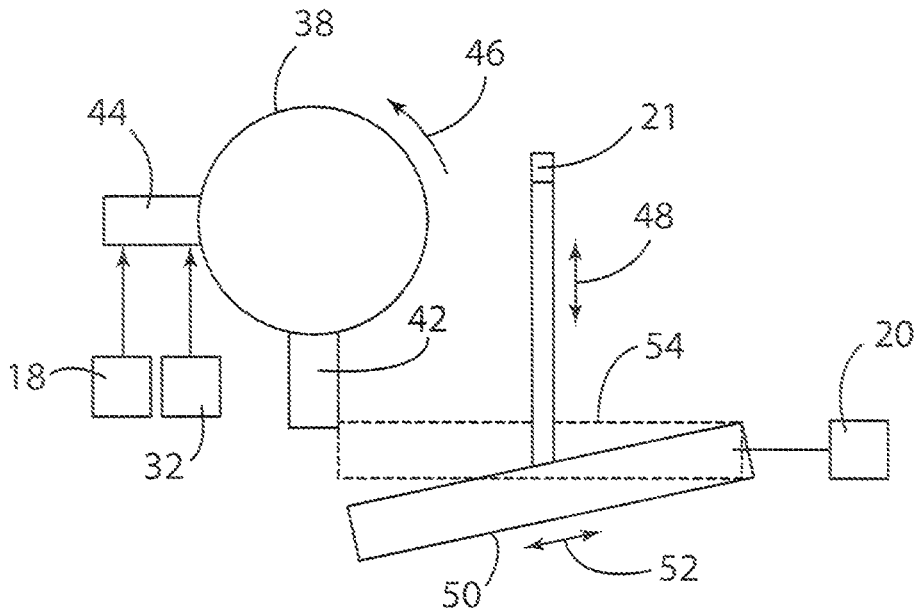
FIG. 4 is a schematic view of the present invention showing movement of a pawl of the present invention.

It is also contemplated that the illustrated latch system 10 can have the actuator 18 mechanically engaged with the pawl 38 and configured to move the pawl 38 to stop the pawl 38 from maintaining the catch 36 in the closed position, thereby allowing the door to move to the open location. It is contemplated that the actuator 18 could include any element for moving the pawl 38 (e.g., a rotary actuator or a linear actuator). FIG. 4 illustrates an example of the actuator moving the pawl 38. In FIG. 4, the actuator 38 is a linear actuator configured to move a prong 44 on the pawl 38 such that the pawl 38 moves in a clock-wise direction to overcome a baising force 46 applied to the pawl 38. Therefore, the actuator 18 can be activated to open the door by moving the pawl 38 via movement of the prong 44 on the pawl 38. Accordingly, the catch 36 would move to the open position, thereby allowing the door to move to the open location. The actuator 18 can also be employed to prevent the pawl 38 from moving by maintaining the prong 44 of the pawl 38 in its initial position as illustrated in FIG. 4.

The illustrated actuator 18 can be activated by a signal from the door module 14. For example, the actuator 18 can be activated to open the door by actuation of the inside handle 20 or the outside handle 22. It is also contemplated that the door module 14 could receive a remote signal such that the door automatically opens (for example, with a button on a key chain wirelessly sending a signal to the door module 14 telling the door module 14 to open the door). The actuator 18 can also be used to prevent the door from moving to the open location (e.g., when the door module 14 is set in a child-lock state) by continuously moving the prong 44 of the pawl 38 back to its initial position to prevent the pawl 38 from rotating. It is noted that the actuator 18 only works when the vehicle has power (or when the actuator 18 is powered). Therefore, when the vehicle (or actuator 18) does not have power, the door can only be moved to the open location from the inside using the emergency inside lock/unlock toggle lever 21.

In the illustrated example, the emergency inside lock/unlock toggle lever 21 comprises a member that is actuated to mechanically connect the inside handle 20 to the pawl 38. The emergency inside lock/unlock toggle lever 21 is located within the interior of the vehicle and can be manually actuated. It is contemplated that the emergency inside lock/unlock toggle lever 21 could include any element for mechanically connecting the inside handle 20 with the pawl 38. FIG. 4 illustrates an example of the emergency inside lock/unlock toggle lever 21 for moving the pawl 38. In FIG. 4, the emergency inside lock/unlock toggle lever 21 comprises an elongated member connected to a second member 50 connected to the inside handle 20.

When the emergency inside lock/unlock toggle lever 21 is not activated, the second member 50 moves along line 52 without abutting any element within the door. However, when the emergency inside lock/unlock toggle lever 21 is activated, the emergency inside lock/unlock toggle lever 21 is moved along line 48 to pull the second member 50 into alignment with a projection on the pawl 38. The second member 50 is shown in phantom as element 54 in FIG. 4. Once the second member 50 is in alignment with the projection on the pawl 38, actuation of the inside handle 20 will move the extension 42 on the pawl 38 such that the pawl 38 moves in a clock-wise direction to overcome the baising force 46 applied to the pawl 38. Therefore, the emergency inside lock/unlock toggle lever 21 can be activated and used in combination with the inside handle 20 to open the door by moving the pawl 38 via movement of the extension 42 on the pawl 38. Accordingly, the catch 36 would move to the open position, thereby allowing the door to move to the open location.

In the illustrated example, the unlatch key cylinder 32 functions similar to the actuator 18. The unlatch key cylinder 32 allows a person outside the vehicle to open the door. The unlatch key cylinder 32 is mechanically engaged with the pawl 38. The unlatch key cylinder 32 is configured to accept a key of a user of the vehicle. The unlatch key cylinder 32 can comprise a typical cylinder lock. The unlatch key cylinder 32 is configured to move the pawl 38 in the same manner the actuator 18 moves the pawl 38. For example, the unlatch key cylinder 32 can move the prong 44 or the extension 42 of the pawl 38. Therefore, the unlatch key cylinder 32 can be used to open the door by moving the pawl 38. Accordingly, the catch 36 would move to the open position, thereby allowing the door to move to the open location.

Referring next to FIGS. 5-8, flowcharts of a vehicle front/rear door inside/outside release operation are provided.

Figure 5:
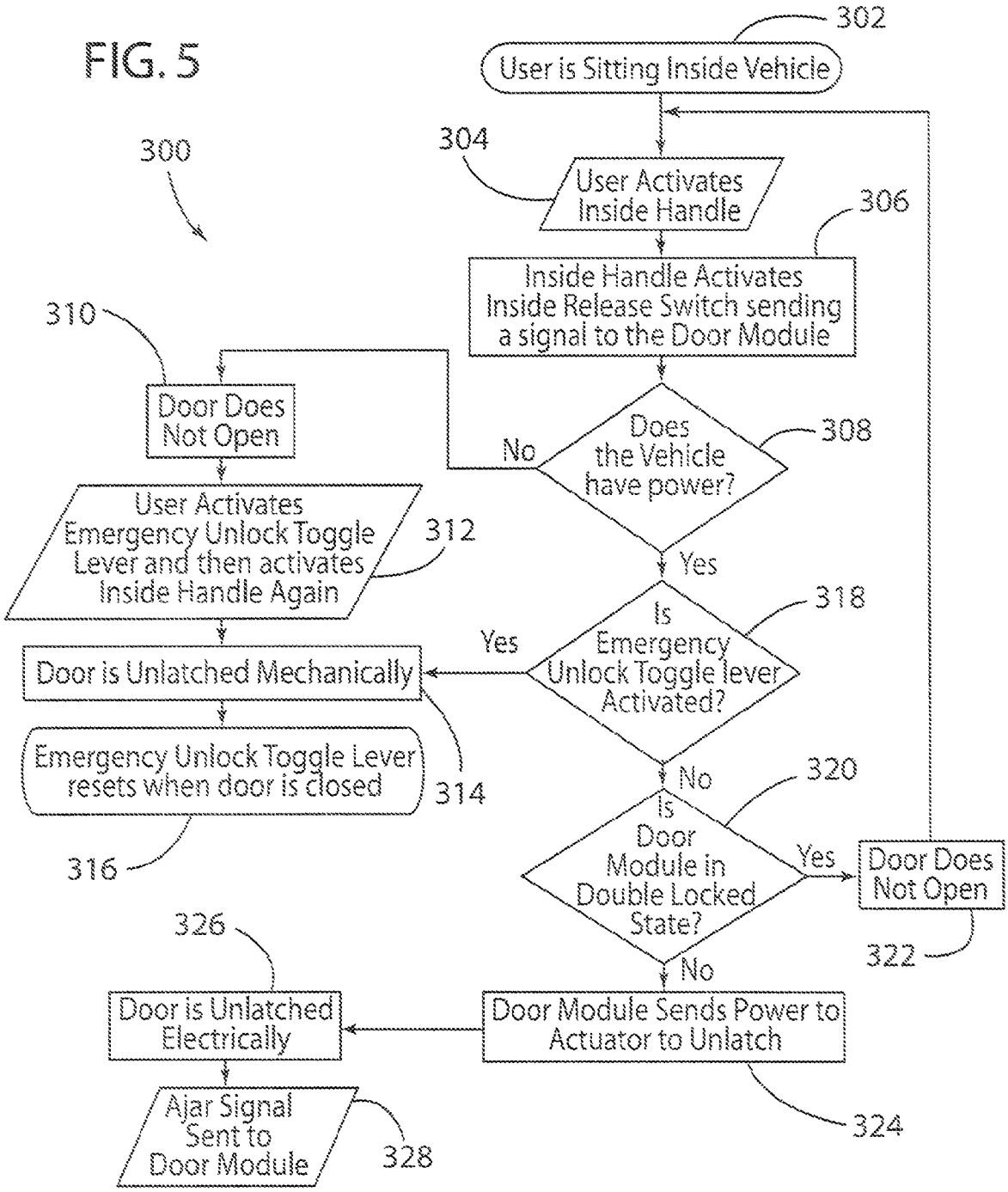
FIG. 5 is a flow chart illustrating a front door inside release operation.

Specifically, referring to FIG. 5, a front door inside release operation 300 will be described in detail. For front door inside release operation 300, at step 302, a user is seated inside the vehicle, and at step 304, the user actuates the inside handle 20. At step 306, when the user actuates the inside handle 20, the inside release switch 27 is activated, thus sending a signal to the door module 14. At step 308, if the vehicle has power, the method continues to step 318. At step 318, if the vehicle does not have the emergency inside lock/unlock toggle lever 21 activated, the method continues to step 320. At step 320, the door module 14 determines if the door module 14 is in a double locked state. If the determination at step 320 is yes, then at step 322, the vehicle door does not open. If the vehicle does not have power as determined at step 308, then at step 310, the vehicle door does not open until the user activates the emergency inside lock/unlock toggle lever 21 and actuates the inside handle 20 again at step 312. Thereafter, at step 314, the door is unlatched mechanically. Moreover, the emergency inside lock/unlock toggle lever 21 resets when the door is closed at step 316. If the determination at step 318 is yes (such that the emergency inside lock/unlock toggle lever 21 is activated, the method continues to step 314 wherein the door is unlatched mechanically and then to step 316 wherein the emergency inside lock/unlock toggle lever 21 resets. If the determination at step 320 is no (such that the door module 14 is not in a double locked state), the method 300 continues to step 324 where the door module 14 instructs the actuator 18 to allow the door to move to the open location at step 326 (by moving the pawl 38 as discussed above). Thereafter, at step 328, a signal is sent to the door module 14 telling the door module 14 that the door is ajar (or in the open location) such that the door module 14 can send a signal to the actuator 18 to reset the pawl 38 once the door is closed.

Figure 6:
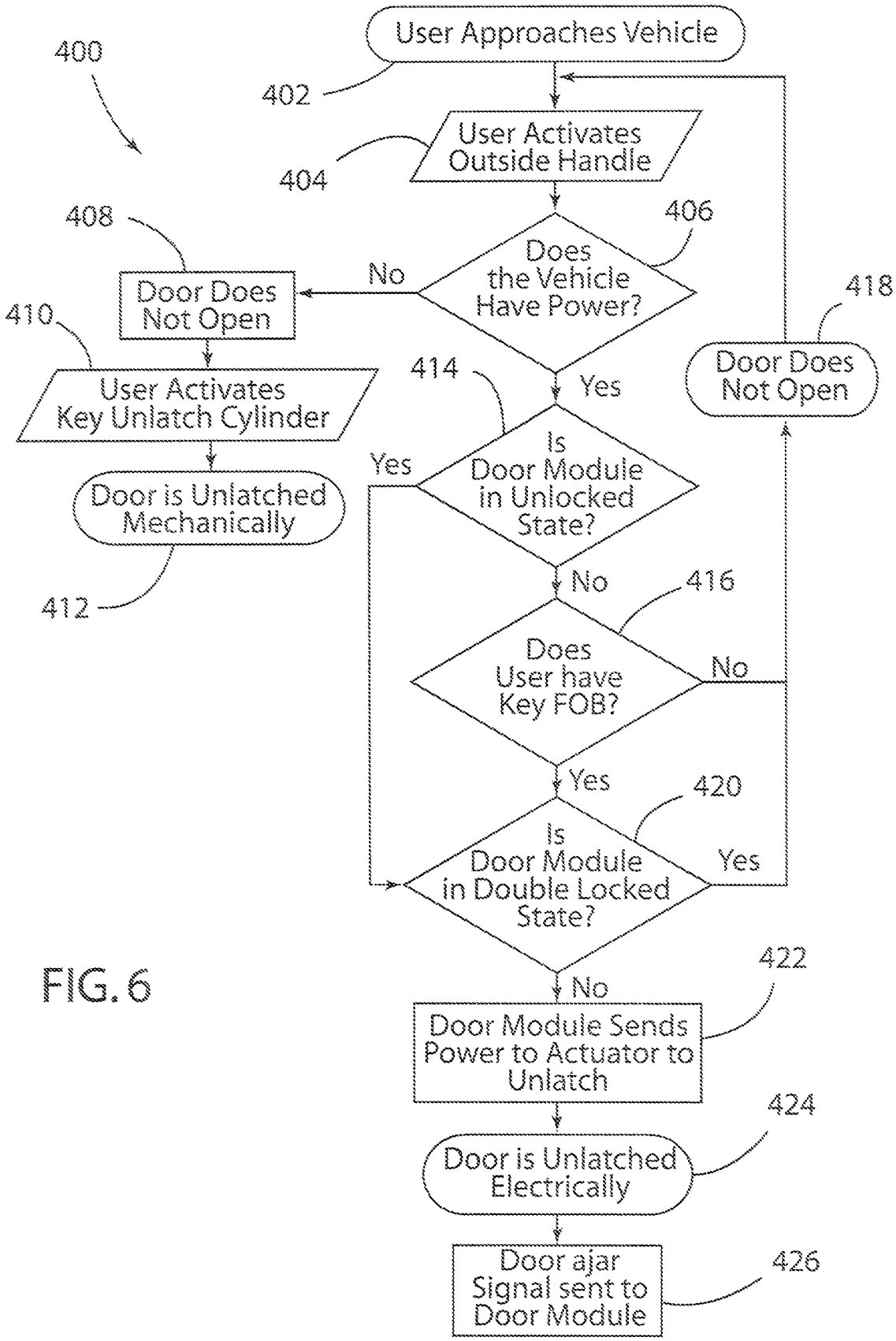
FIG. 6 is a flow chart illustrating a front door outside release operation.

Referring to FIG. 6, a front door outside release operation 400 will be described in detail. For front door outside release operation 400, at step 402, a user approaches an outside of the vehicle, and at step 404, the user actuates the outside handle 22. At step 406, if the vehicle has no power, the method continues to step 408. At step 408, the door does not open until the user actuates the key unlatch cylinder 32 at step 410 to mechanically move the door to the open location at step 412. If the vehicle does have power as determined at step 406, then at step 414, the door module 14 determines if the door module 14 is in an unlocked state. If the determination at step 414 is no, then at step 416, the door module 14 determines if the user has a key FOB for moving the door module 14 to the unlocked state. If the user does not have a key FOB at step 416, then at step 418, the vehicle door does not open. If the user does have a key FOB at step 416, at step 418, the door module 14 determines if the door module 14 is a double locked state. If the door module 14 is in the double locked state, then at step 418, the vehicle door does not open. If the determination at step 420 is no (such that the door module 14 is not in a double locked state) or if the determination at step 414 is yes (such that the door module 14 is in an unlocked state), the method 400 continues to step 422 where the door module 14 instructs the actuator 18 to allow the door to move to the open location at step 424 (by moving the pawl 38 as discussed above). Thereafter, at step 426, a signal is sent to the door module 14 telling the door module 14 that the door is ajar (or in the open location) such that the door module 14 can send a signal to the actuator 18 to reset the pawl 38 once the door is closed.

Figure 7:
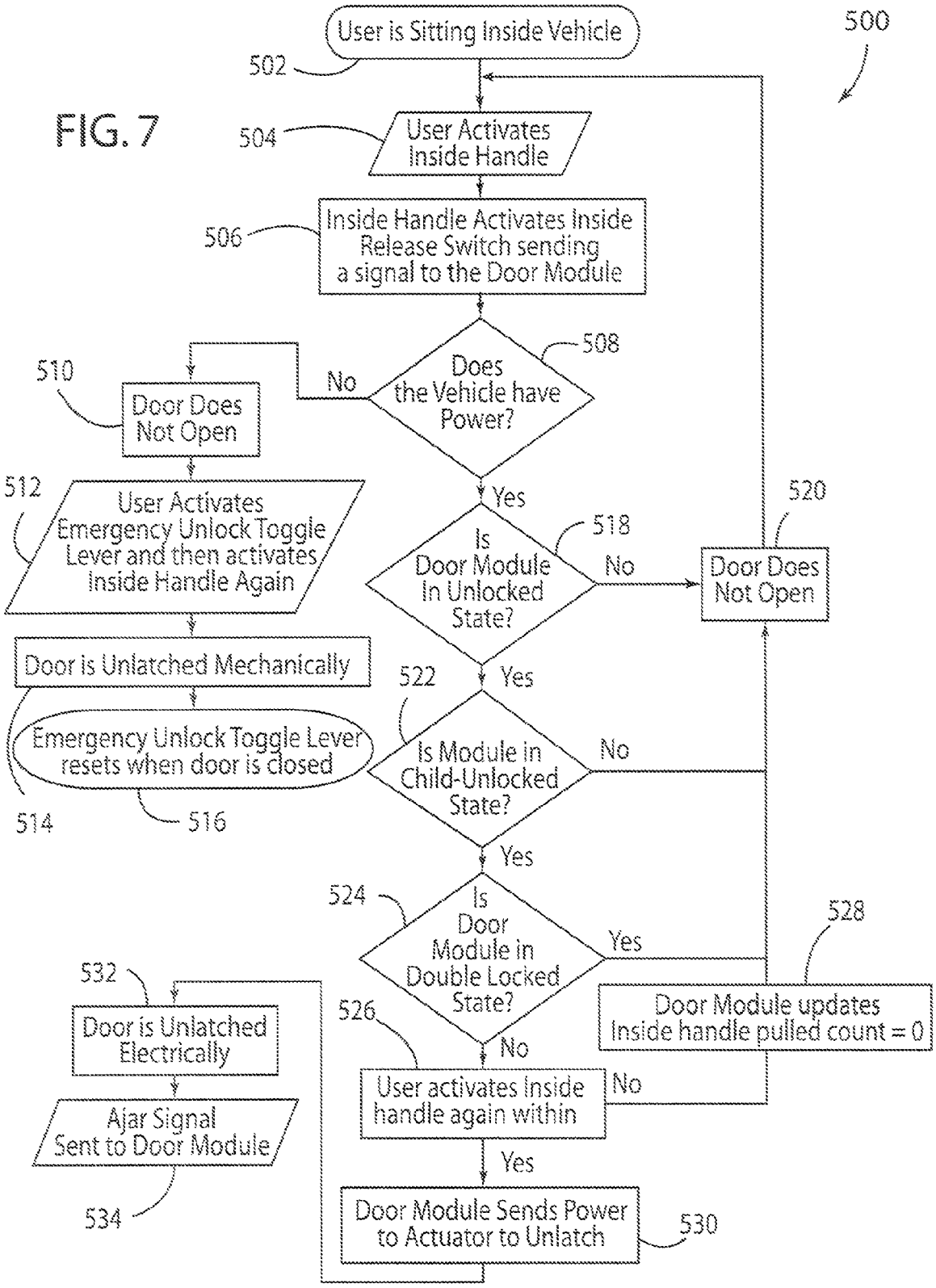
FIG. 7 is a flow chart illustrating a rear door inside release operation.

Referring to FIG. 7, a rear door inside release operation 500 will be described in detail. For rear door inside release operation 500, at step 502, a user is seated inside the vehicle, and at step 504, the user actuates the inside handle 20. At step 506, when the user actuates the inside handle 20, an inside release switch 27 is activated, thus sending a signal to the door module 14. At step 508, if the vehicle does not have power, the method continues to step 510. At step 510, the vehicle door does not open until the user activates the emergency inside lock/unlock toggle lever 21 and actuates the inside handle 20 again at step 512. Thereafter, at step 514, the door is unlatched mechanically. Moreover, the emergency inside lock/unlock toggle lever 21 resets when the door is closed at step 516. If the vehicle does have power as determined at step 508, then at step 518, the door module 14 determines if the door module 14 is in an unlocked state. If the determination at step 510 is no, then at step 520, the vehicle door does not open. If the door module 14 is in the unlocked state as determined at step 518, then at step 522, the door module 14 determines if the door module 14 is in a child-unlocked state. If the determination at step 522 is no, then at step 520, the vehicle door does not open. If the door module 14 is in the child-unlocked state as determined at step 522, then at step 524, the door module 14 determines if the door module 14 is in a double locked state. If the determination at step 524 is yes, then at step 520, the vehicle door does not open. If the determination at step 524 is no (such that the door module 14 is not in a double locked state), the method 500 continues to step 526 where the door module 14 determines the user has actuated the inside handle 20 again within a certain time period (e.g, 5 seconds) of the first actuation of the inside handle 20. If the inside handle 20 has not been actuated a second time within the certain time period, the method continues first to step 528 wherein the door module 14 updates an inside handle actuation count (within its memory) to zero (such that the next actuation of the inside handle will be considered the first actuation of the inside handle 20) and then to step 520 wherein the door does not open. If the determination at step 526 determines that the inside handle 20 was actuated a second time within the certain time period, the method 500 continues to step 530 where the door module 14 instructs the actuator 18 to allow the door to move to the open location at step 532 (by moving the pawl 38 as discussed above). Thereafter, at step 534, a signal is sent to the door module 14 telling the door module 14 that the door is ajar (or in the open location) such that the door module 14 can send a signal to the actuator 18 to reset the pawl 38 once the door is closed. It is noted that if it is desired to have the door open with only one actuation of the inside handle 20, the method 500 can proceed from step 524 directly to step 530 if the vehicle is not in the double locked state.

Figure 8:
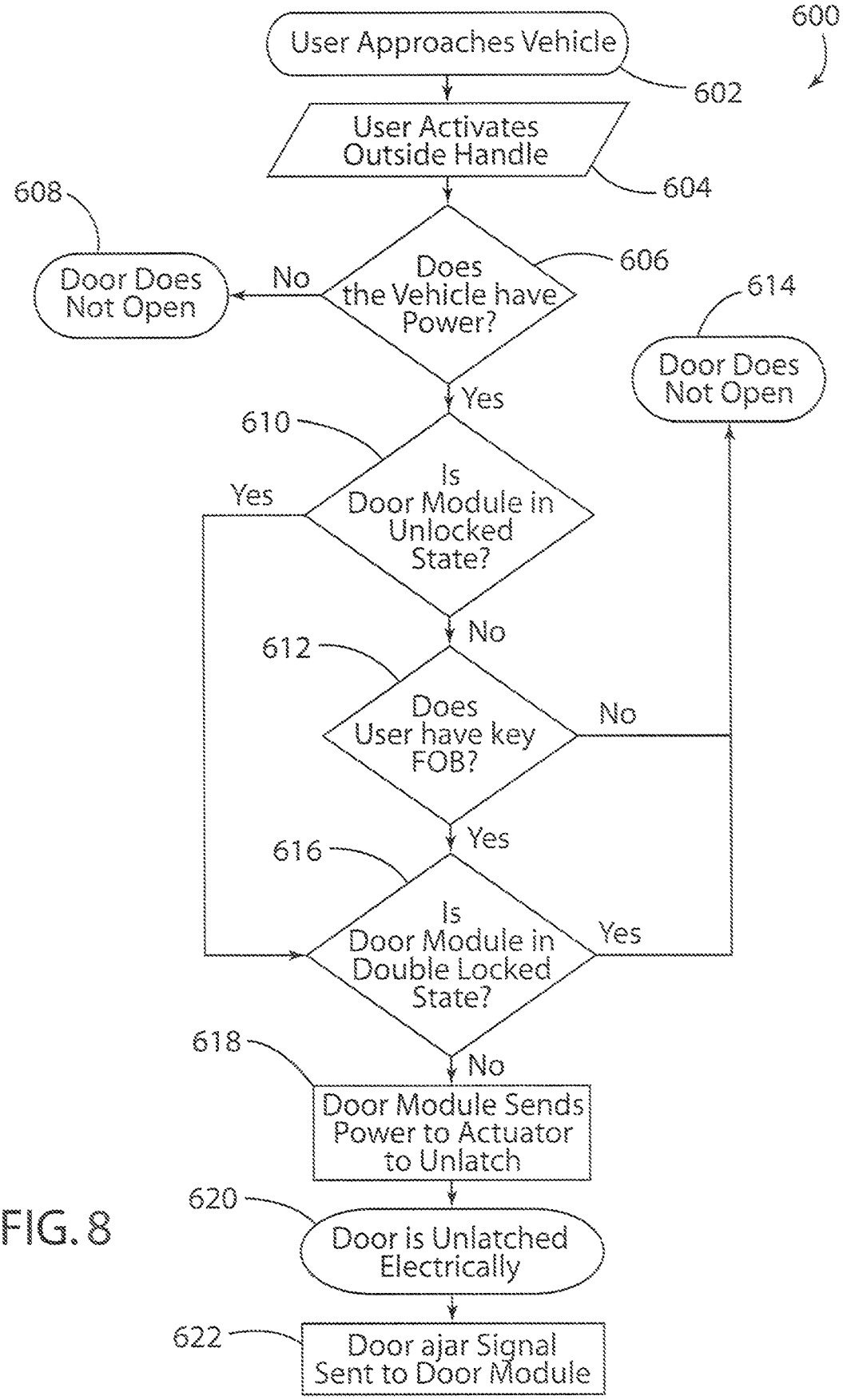
FIG. 8 is a flow chart illustrating a rear door outside release operation.

Referring to FIG. 8, a rear door outside release operation 600 will be described in detail. For rear door outside release operation 600, at step 602, a user approaches an outside of the vehicle, and at step 604, the user actuates the outside handle 22. At step 606, if the vehicle has no power, the method continues to step 608, where the door does not open. If the vehicle does have power as determined at step 606, then at step 610, the door module 14 determines if the door module 14 is an unlocked state. If the determination at step 610 is no, then at step 612, the door module 14 determines if the user has a key FOB for moving the door module 14 to the unlocked state. If the user does not have a key FOB at step 612, then at step 614, the vehicle door does not open. If the user does have a key FOB at step 612, then at step 616, the door module 14 determines if the door module 14 is in a double locked state. If the door module 14 is in the double locked state, then at step 614, the vehicle door does not open. If the determination at step 616 is no (such that the door module 14 is not in a double locked state) or if the determination at step 610 is yes (such that the door modulce 14 is in an unlocked state), the method 600 continues to step 618 where the door module 14 instructs the actuator 18 to allow the door to move to the open location at step 620 (by moving the pawl 38 as discussed above). Thereafter, at step 622, a signal is sent to the door module 14 telling the door module 14 that the door is ajar (or in the open location) such that the door module 14 can send a signal to the actuator 18 reset the pawl 38 once the door is closed.

To summarize, latch system 10 thus provides a universal door latching system which may be readily operable by electronic door module 14 for meeting different government regulations or customer requirements. For example, the latch system 10 may be operable to include a rear door latch override as allowed in Europe, and maintain the rear door latch override function for the U.S. or similar markets. The latch system 10 may also be readily adaptable for feature upgrades (e.g., power child locks, fast unlock, etc.), and require minimal modifications for design aspects involving mounting hole patterns, electrical connectors, rod versus handles, etc. Thus, the latch system 10 provides a common front and side door latch system on a global scale, while also reducing product development time, costs and tooling related to side door latches.

The latch system may support both fixed and moving outside handle applications with no change to the latch. Yet further, as also discussed above, the door module 14 may provide multiple functionalities depending on the signal(s) received from the outside and inside release handles upon activation. In a particular embodiment, the outside handle may be a purely electrical release. Yet further, the latch assembly 12 may include no lock levers, and the latch system 10 may be purely within the memory of the door module 14. The power child lock function may be provided by the logic of the door module 14, with no additional motors or child-lock levers in the latch assembly 12.

It is to be understood that variations and modifications can be made on the aforementioned structure without departing from the concepts of the present invention. For example, it is contemplated that the door module 14 could be configured to only allow the door to move to the open location if the vehicle is traveling below a certain speed (e.g., 3 miles per hour) and/or if no crash is detected. Moreover, it is contemplated that the door module 14 could include a visual indication if any or all of the doors are in a locked state (e.g., an LED indicator 223). Further, it is to be understood that such concepts are intended to be covered by the following claims unless these claims by their language expressly state otherwise.

We claim:

1. A latch system for a door of a vehicle comprising:

a latch assembly for maintaining the door in a closed location, the latch assembly including a catch and a pawl, the catch having a closed position wherein the catch is configured to grasp a portion of the vehicle to maintain the door in the closed location and an open position wherein the catch is configured to release the portion of the vehicle to allow the door to move to an open location, the pawl being configured to maintain the catch in the closed position;

an actuatable inside handle;

a powered actuator engaged with the latch assembly, the powered actuator being configured to be activated by actuation of the inside handle;

an emergency release lever being movable between an on position and an off position, the emergency release lever being engaged with the actuatable inside handle, wherein the emergency release lever can be manually actuated from within an interior of a vehicle when the door is in a closed position;

wherein the catch is configured to be moved to the open position after actuation of the inside handle by activating the powered actuator to thereby cause powered movement of the pawl to stop the pawl from maintaining the catch in the closed position when the vehicle has power;

wherein the catch is configured to be moved to the open position after actuation of the inside handle by moving the emergency release lever to the on position to mechanically interconnect the inside handle with the pawl to stop the pawl from maintaining the catch in the closed position to permit the door to be opened, and wherein the emergency release lever resets to the off position when the door is closed; and wherein the inside handle is not mechanically interconnected to the pawl when the emergency release lever is in the off position such that actuation of the inside handle will not mechanically move the pawl when the emergency release lever is in the off position.

2. The latch system for a door of a vehicle as claimed in claim 1, wherein:

the latch assembly has a locked condition wherein the pawl is prevented from releasing the catch; and if the latch assembly is in the locked condition, the powered actuator prevents actuation of the inside handle from actuating the pawl to stop the pawl from maintaining the catch in the closed position.

3. The latch system for a door of a vehicle as claimed in claim 1, further including:

a key unlatch cylinder configured to be accessible from an exterior of the vehicle, the key unlatch cylinder being configured to be actuated after engagement with a key, the key unlatch cylinder being engaged with the pawl; and wherein the catch is configured to be moved to the open position after actuation of the key unlock cylinder to thereby move the pawl to stop the pawl from maintaining the catch in the closed position.

4. The latch system for a door of a vehicle as claimed in claim 1, wherein:

the powered actuator is configured to be able to maintain the pawl in a stationary position whereby the pawl maintains the catch in the closed position.

5. The latch system for a door of a vehicle as claimed in claim 1, further including:

an actuatable outside handle;

wherein the latch assembly has a locked condition wherein the pawl is prevented from releasing the catch; and wherein the catch is configured to be moved to the open position after actuation of the outside handle by activating the powered actuator to thereby move the pawl to stop the pawl from maintaining the catch in the closed position when the vehicle has power and when the latch assembly is in the locked condition.

6. The latch system for a door of a vehicle as claimed in claim 1, further including:

an inside release switch activated by actuation of the inside handle, the inside release switch sending a signal to the actuator to move the pawl.

7. The latch system for a door of a vehicle as claimed in claim 6, further including:

a door module electronically connected between the inside release switch and the powered actuator, the door module selectively activating the powered actuator.

8. The latch system for a door of a vehicle as claimed in claim 7, wherein:

the door module only activates the powered actuator to move the pawl after the inside handle has been actuated twice within a predetermined time period.

9. A method of controlling a location of a door of a vehicle comprising:

providing a latch assembly for maintaining the door in a closed location, the latch assembly including a catch and a pawl, the catch having a closed position wherein the catch is configured to grasp a portion of the vehicle to maintain the door in the closed location and an open position wherein the catch is configured to release the portion of the vehicle to allow the door to move to an open location, the pawl being configured to maintain the catch in the closed position;

providing an actuatable inside handle;

engaging a powered actuator with the latch assembly;

providing an emergency release lever being movable between an on position and an off position, the emergency release lever being engaged with the actuatable inside handle, wherein the emergency release lever can be manually actuated from within an interior of a vehicle when the door is in a closed position;

opening the door when the vehicle has power by moving the catch to the open position by actuating the inside handle to activate the powered actuator such that the powered actuator causes the pawl to move to stop the pawl from maintaining the catch in the closed position; and opening the door by moving the catch to the open position after actuation of the inside handle by moving the emergency release lever within the interior of the vehicle to the on position and mechanically interconnecting the inside handle with the pawl to stop the pawl from maintaining the catch in the closed position;

closing the door;

resetting the emergency release lever to the off position when the door is closed;

wherein the inside handle is not mechanically interconnected to the pawl when the emergency release lever is in the off position such that actuation of the inside handle will not mechanically move the pawl when the emergency release lever is in the off position.

10. The method of controlling a location of a door of a vehicle as claimed in claim 9, wherein:

the latch assembly has a locked condition wherein the pawl is prevented from releasing the catch; and if the latch assembly is in the locked condition, the powered actuator prevents actuation of the inside handle from actuating the pawl to stop the pawl from maintaining the catch in the closed position.

11. The method of controlling a location of a door of a vehicle as claimed in claim 9, further including:

providing a key unlatch cylinder configured to be accessible from an exterior of the vehicle, the key unlatch cylinder being configured to be actuated after engagement with a key, the key unlatch cylinder being engaged with the pawl; and wherein the catch is configured to be moved to the open position after actuation of the key unlock cylinder to thereby move the pawl to stop the pawl from maintaining the catch in the closed position.

12. The method of controlling a location of a door of a vehicle as claimed in claim 9, wherein:

the powered actuator is configured to be able to maintain the pawl in a stationary position whereby the pawl maintains the catch in the closed position.

13. The method of controlling a location of a door of a vehicle as claimed in claim 9, further including:

providing an actuatable outside handle;

wherein the latch assembly has a locked condition wherein the pawl is prevented from releasing the catch; and wherein the catch is configured to be moved to the open position after actuation of the outside handle by activating the powered actuator to thereby cause powered movement of the pawl to stop the pawl from maintaining the catch in the closed position when the vehicle has power and when the latch assembly is in the locked condition.

14. The method of controlling a location of a door of a vehicle as claimed in claim 9, further including:

activating an inside release switch by actuation of the inside handle; and sending a signal from the inside release switch to the powered actuator to move the pawl.

15. The method of controlling a location of a door of a vehicle as claimed in claim 14, further including:

electronically connecting a door module between the inside release switch and the actuator; and selectively activating the powered actuator with the door module.

16. The method of controlling a location of a door of a vehicle as claimed in claim 15, wherein:

the door module only activates the actuator to move the pawl after the inside handle has been actuated twice within a predetermined time period.

17. A latch system for a door of a vehicle comprising:

a latch assembly for maintaining the door in a closed location, the latch assembly including a catch and a pawl, the catch having a closed position wherein the catch is configured to grasp a portion of the vehicle to maintain the door in the closed location and an open position wherein the catch is configured to release the portion of the vehicle to allow the door to move to an open location, the pawl being configured to maintain the catch in the closed position, the latch assembly having a locked condition wherein the pawl is prevented from releasing the catch;

an actuatable inside handle;

an actuatable outside handle;

a powered actuator engaged with the latch assembly, the powered actuator being configured to be activated by actuation of the inside handle and actuation of the outside handle;

an emergency release lever being movable between an on position and an off position, the emergency release lever being engaged with the actuatable inside handle, wherein the emergency release lever can be manually actuated from within an interior of a vehicle when the door is in a closed position;

wherein the catch is configured to be moved to the open position after actuation of the inside handle by activating the powered actuator to thereby move the pawl to stop the pawl from maintaining the catch in the closed position when the vehicle has power;

wherein the catch is configured to be moved to the open position after actuation of the inside handle by moving the emergency release lever to the on position to mechanically interconnect the inside handle with the pawl to stop the pawl from maintaining the catch in the closed position to permit the door to be opened, and wherein the emergency release lever resets to the off position when the door is closed;

wherein the inside handle is not mechanically interconnected to the pawl when the emergency release lever is in the off position such that actuation of the inside handle will not mechanically move the pawl when the emergency release lever is in the off position;

if the latch assembly is in the locked condition, the powered actuator prevents actuation of the inside handle from actuating the pawl to stop the pawl from maintaining the catch in the closed position; and wherein the catch is configured to be moved to the open position after actuation of the outside handle by activating the powered actuator to thereby move the pawl to stop the pawl from maintaining the catch in the closed position when the vehicle has power and when the latch assembly is in the locked condition.

18. The latch system for a door of a vehicle as claimed in claim 17, further including:

an inside release switch activated by actuation of the inside handle, the inside release switch sending a signal to the powered actuator to move the pawl.

19. The latch system for a door of a vehicle as claimed in claim 18, further including:

a door module electronically connected between the inside release switch and the powered actuator, the door module selectively activating the powered actuator.

20. The latch system for a door of a vehicle as claimed in claim 19, wherein:

the door module only activates the powered actuator to move the pawl after the inside handle has been actuated twice within a predetermined time period.

* * * * *